US012521604B2

(12) United States Patent
De Leon et al.

(10) Patent No.: US 12,521,604 B2
(45) Date of Patent: Jan. 13, 2026

(54) PHYSICAL THERAPY DEVICE

(71) Applicants: Reid Albert De Leon, League City, TX (US); Eric David Santiago, League City, TX (US); Daniel Tagtow, Austin, TX (US)

(72) Inventors: Reid Albert De Leon, League City, TX (US); Eric David Santiago, League City, TX (US); Daniel Tagtow, Austin, TX (US)

( * ) Notice: Subject to any disclaimer, the term of this patent is extended or adjusted under 35 U.S.C. 154(b) by 0 days.

(21) Appl. No.: 18/097,333

(22) Filed: Jan. 16, 2023

(65) Prior Publication Data

US 2023/0321483 A1 Oct. 12, 2023

Related U.S. Application Data

(63) Continuation-in-part of application No. 17/865,917, filed on Jul. 15, 2022, now abandoned, which is a continuation-in-part of application No. 17/715,929, filed on Apr. 7, 2022, now Pat. No. 12,011,636.

(51) Int. Cl.
*A63B 22/18* (2006.01)
*A63B 21/055* (2006.01)

(52) U.S. Cl.
CPC ..... *A63B 22/18* (2013.01); *A63B 21/0557* (2013.01)

(58) Field of Classification Search
CPC ..... A63B 21/00047; A63B 21/000178; A63B 21/00181; A63B 21/04; A63B 21/0442; A63B 21/169; A63B 21/4035; A63B 17/00; A63B 17/02; A63B 17/04; A63B 6/00; A63B 6/02; A63B 5/08; A63B 5/16
See application file for complete search history.

(56) References Cited

U.S. PATENT DOCUMENTS

| | | | | |
|---|---|---|---|---|
| 5,839,991 | A * | 11/1998 | Hall | A63B 23/00 482/910 |
| 6,066,105 | A * | 5/2000 | Guillen | A63B 69/0053 600/595 |
| 9,737,748 | B1 * | 8/2017 | Chapman | A63B 21/1681 |
| 9,821,184 | B1 * | 11/2017 | Chapman | A61H 1/024 |
| 10,315,065 | B1 * | 6/2019 | Soba | A63B 21/151 |
| 10,736,485 | B1 * | 8/2020 | Galbraith | A47L 23/266 |
| 2009/0031658 | A1 * | 2/2009 | Moller, Jr. | E01C 13/045 52/578 |
| 2012/0184409 | A1 * | 7/2012 | Beal | A63B 69/0048 482/5 |
| 2015/0231469 | A1 * | 8/2015 | Pretz | A63B 21/169 473/458 |
| 2015/0367158 | A1 * | 12/2015 | Pretz | A63B 21/0557 482/129 |
| 2017/0136724 | A1 * | 5/2017 | Dawson | D05C 17/02 |

(Continued)

FOREIGN PATENT DOCUMENTS

WO WO-2022108991 A2 * 5/2022 ..... A63B 69/0048

*Primary Examiner* — Zachary T Moore
(74) *Attorney, Agent, or Firm* — John R. Ross, III; John R. Ross

(57) ABSTRACT

A physical therapy device. At least one mount section is mounted onto a vertical surface. The mount section includes a plurality of cutout sections. A strap attachment clip is connected to one of the cutout sections. A plurality of spacers is utilized to separate the mount section from the vertical surface. In a preferred embodiment the mount section is rectangular.

11 Claims, 13 Drawing Sheets

(56) References Cited

U.S. PATENT DOCUMENTS

| | | | | |
|---|---|---|---|---|
| 2018/0104530 | A1* | 4/2018 | Dobronyi | A63B 21/4037 |
| 2020/0023257 | A1* | 1/2020 | Speed | A63B 69/0048 |
| 2020/0171369 | A1* | 6/2020 | Sudeith | A63B 69/0048 |
| 2021/0101061 | A1* | 4/2021 | Pell | A63B 69/0048 |
| 2022/0257990 | A1* | 8/2022 | Hetrick | A63B 21/02 |
| 2022/0370871 | A1* | 11/2022 | Richert | A63B 71/0672 |

* cited by examiner

PHYSICAL THERAPY DEVICE

The present invention relates to exercise and physical therapy devices, and in particular to wall mounted physical therapy devices. This application is a Continuation-in-Part of U.S. patent application Ser. No. 17/865,917 filed Jul. 15, 2022, which is a Continuation-in-Part of U.S. patent application Ser. No. 17/715,929 filed Apr. 7, 2022, all of which are incorporated by reference herein.

BACKGROUND OF THE INVENTION

Physical therapy is a crucial part of modern exercise and rehabilitation. Proper physical therapy can greatly increase the recovery rate after an injury to the body. There are currently numerous types of devices and tools used in physical therapy offices to aid in the treatment of patients. However, many of these tools are lacking in ease of use, flexibility and efficiency. Also, many modern physical therapy aids are very expensive.

What is needed is a better, more efficient and cost-effective physical therapy device.

SUMMARY OF THE INVENTION

The present invention provides a physical therapy device. At least one mount section is mounted onto a vertical surface. The mount section includes a plurality of cutout sections. A strap attachment clip is connected to one of the cutout sections. A plurality of spacers is utilized to separate the mount section from the vertical surface. In a preferred embodiment the mount section is rectangular.

DETAILED DESCRIPTION OF THE PREFERRED EMBODIMENTS

Figure 1:
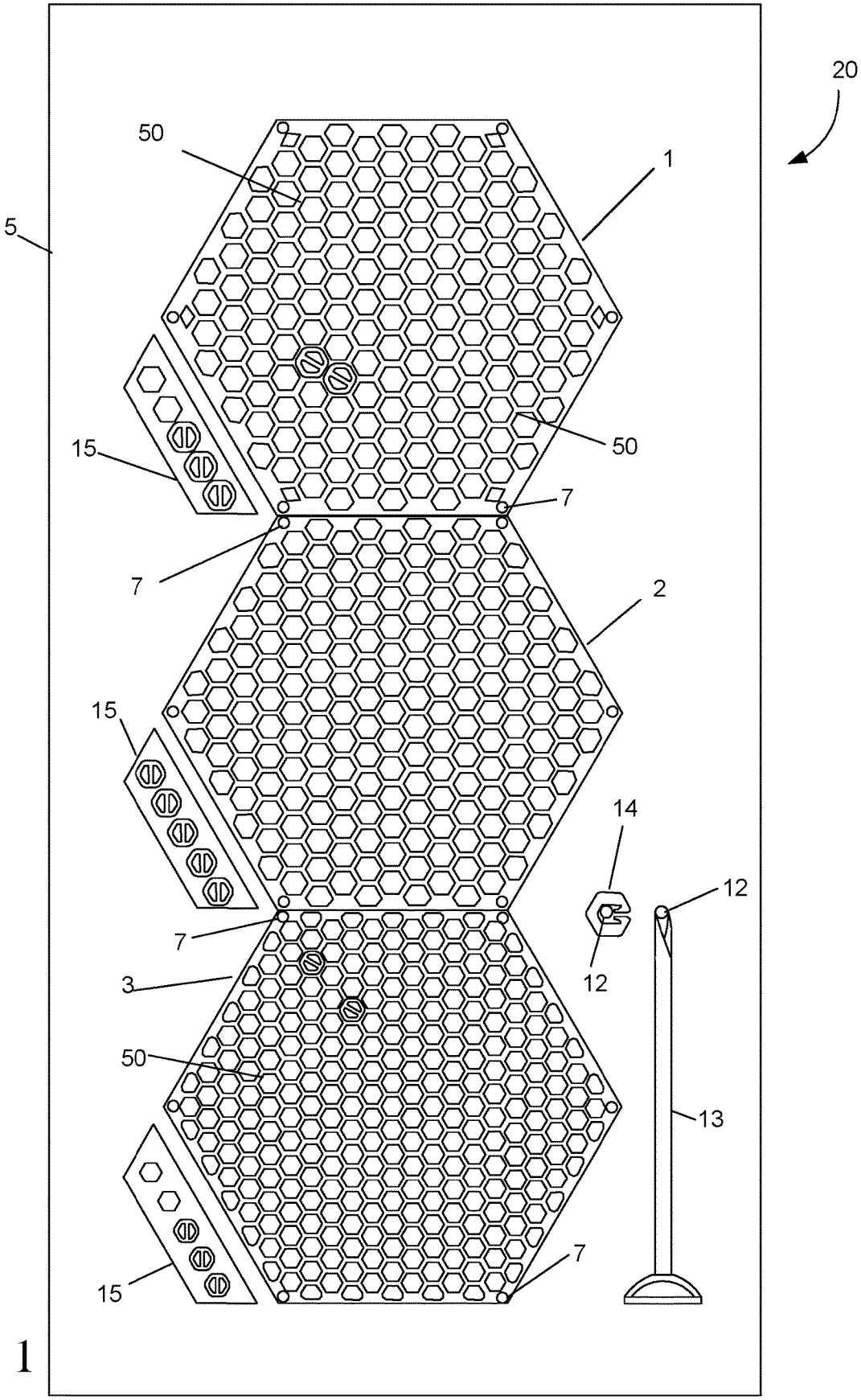
FIG. 1 shows a preferred physical therapy device.

A preferred physical therapy device 20 is shown in FIG. 1. Hexagon mount sections 1, 2 and 3 are shown arranged vertically and rigidly mounted onto backing board 5. In a preferred embodiment, hexagon mount sections 1-3 are each cut from a ½ inch thick high density polyethylene sheet. Each hexagon mount section 1-3 has a plurality of hexagonal cutout sections 50. Hexagonal pegs 10 (also preferably high-density polyethylene) are cut so that they be easily press fit into cutout sections 50. Preferably, cutout sections 50 are kept in backing board mounted peg holders 15 when not placed into hexagon mount sections 1-3. Board mounts 12 are rigidly attached to backing board 5. Strap 13 is shown draped over a board mount 12. Strap attachment piece 14 is shown slipped over another board mount 12.

In a preferred use, a patient will receive physical therapy by interacting with physical therapy device 20. Pegs 10 can be specifically placed onto device 20 in accordance with the patient's needs. The pegs may be placed vertically, horizontally, randomly or in a pattern. The patient may then reach for the pegs or walk his fingers up the mounted pegs, as appropriate. Also, a band or strap may be draped through hexagonal cutout sections as needed. The patient can then pull on the free end of the strap (or a handle attached to the strap) to exercise and rehabilitate.

Mounted Backing Board

In a preferred embodiment, physical therapy device 20 includes backing board 5. In the embodiment shown in FIG. 1, backing board 5 is approximately 6.5 feet×3 feet. Backing board 5 is vertically mounted onto a wall.

Hexagons

Figure 2:
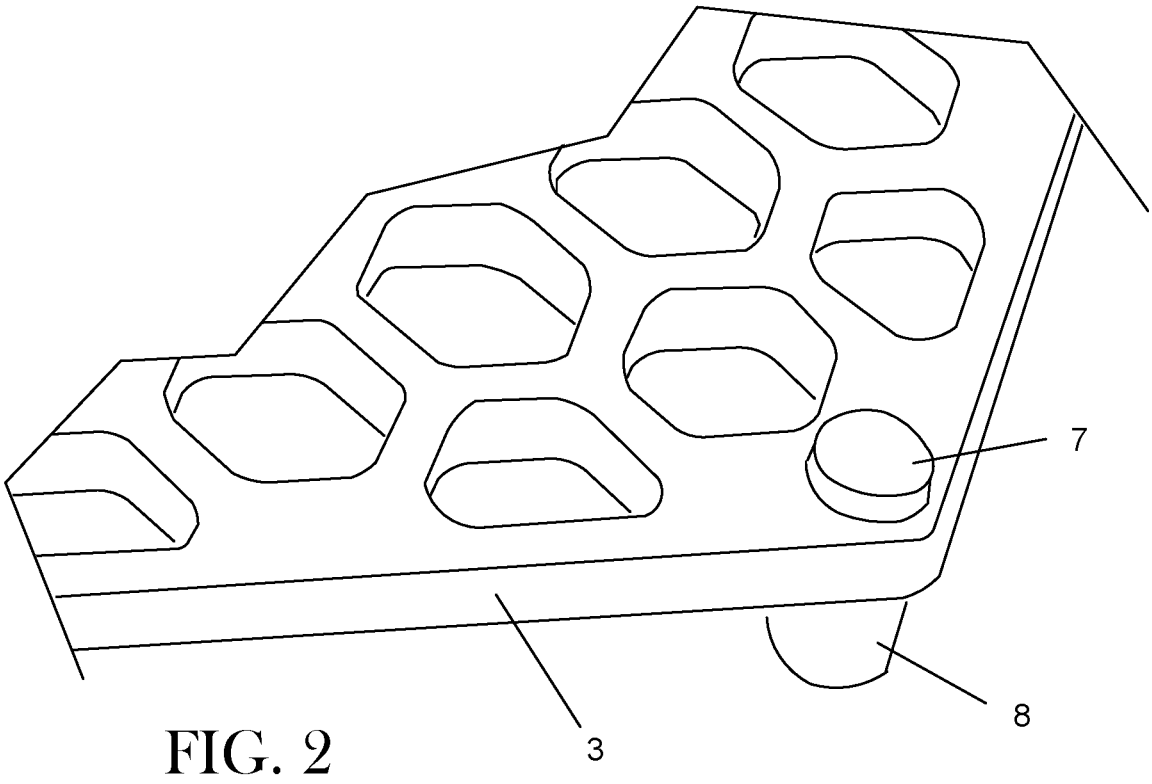
FIG. 2-3 show details of mounting a hexagon mount section.
Figure 3:
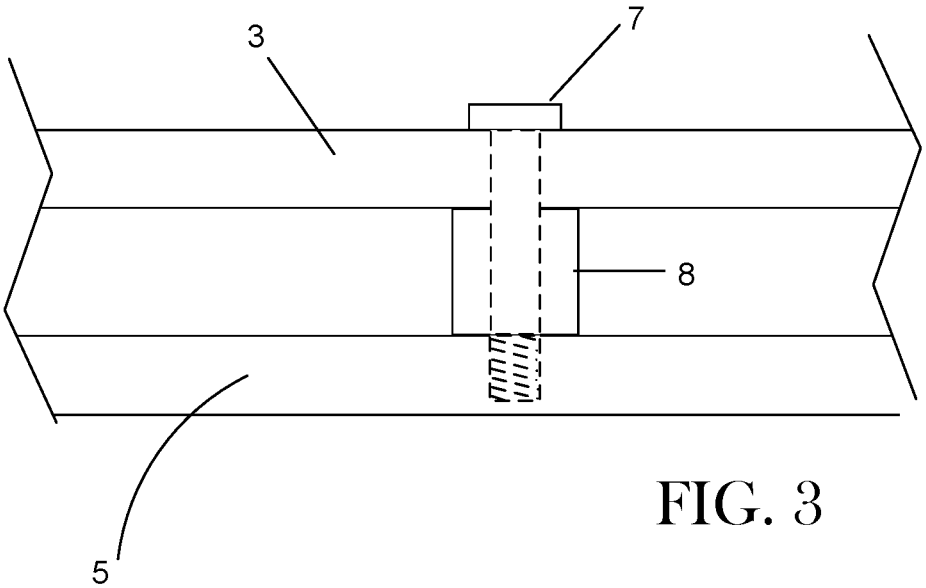

Hexagon mount sections 1-3 are mounted onto backing board 5 vertically as shown. In the embodiment shown in FIG. 1, hexagon mount sections 1-3 are approximately 2 feet in height each. Hexagon mount sections 1-3 are each mounted to backing board 5 using bolts 7 and ¾ inch spacers 8 (FIGS. 2 and 3). Spacers 8 create a space under hexagon mount sections 1-3 so that straps and bands may be easily threaded through hexagonal cutout sections 50.

It should be noted that the hexagonal cutout sections 50 of hexagon mount section 1 are larger than the hexagonal cutout sections 50 of hexagon mount section 2. Also, the hexagonal cutout sections 50 of hexagon mount section 2 are larger than the hexagonal cutout sections of hexagon mount section 3. Likewise, pegs 10 for hexagon mount section 1 are larger than the pegs for hexagon mount section 2. And pegs 10 for hexagon mount section 2 are larger than the pegs for hexagon mount section 3. The variance of size allows for the patient to more specifically customize his workout to maximize the benefit of the physical therapy.

Peg Holders

Figure 4:
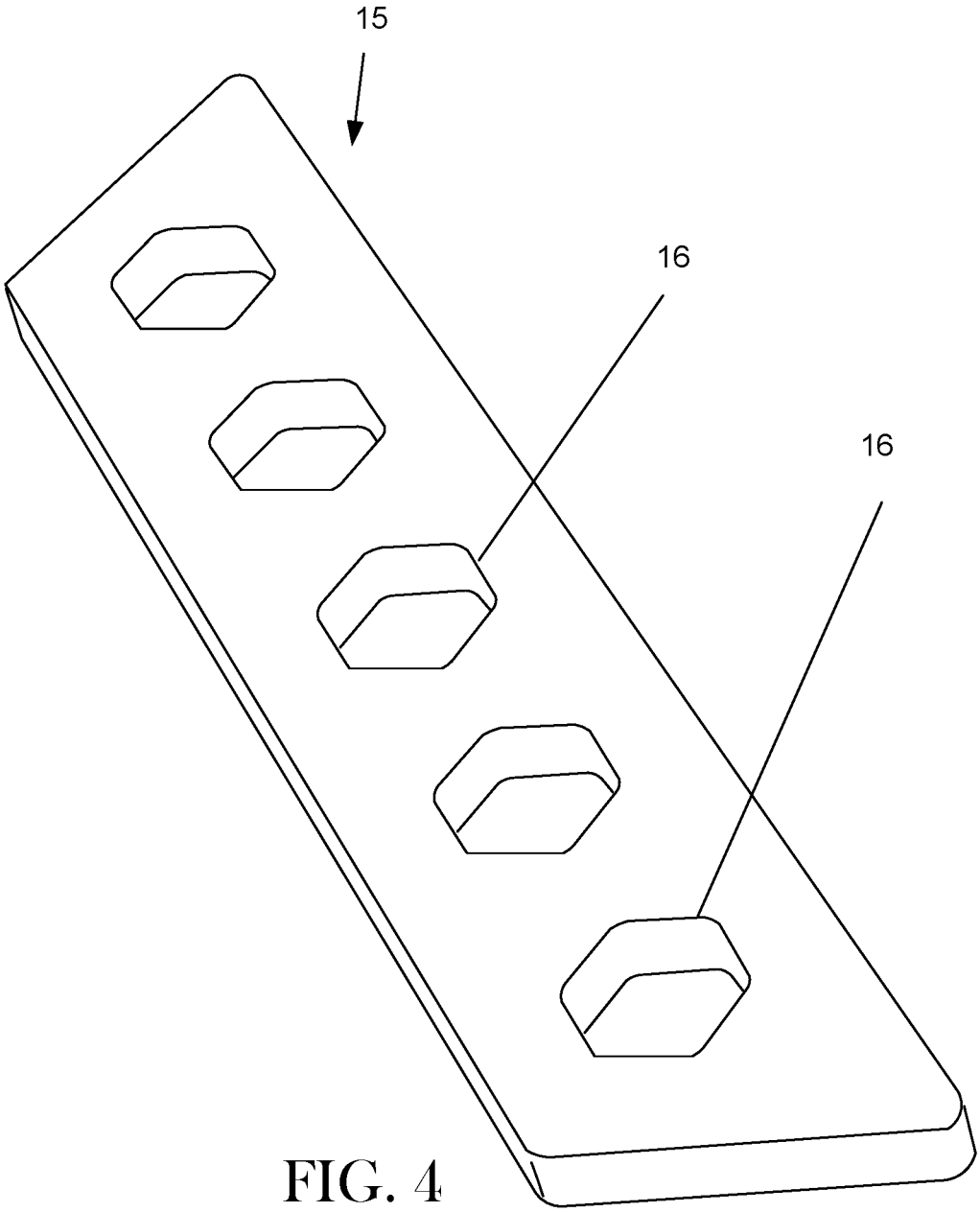
FIG. 4 shows a preferred peg holder.

FIG. 4 shows a close-up perspective view of peg holder 15. Peg holder 15 is rigidly mounted to backing board 5, as shown in FIG. 1. Pegs 10 are press-fit into peg holder 15 for storage when pegs 10 are not inserted into hexagon mount sections 1-3.

Pegs

Figure 5:
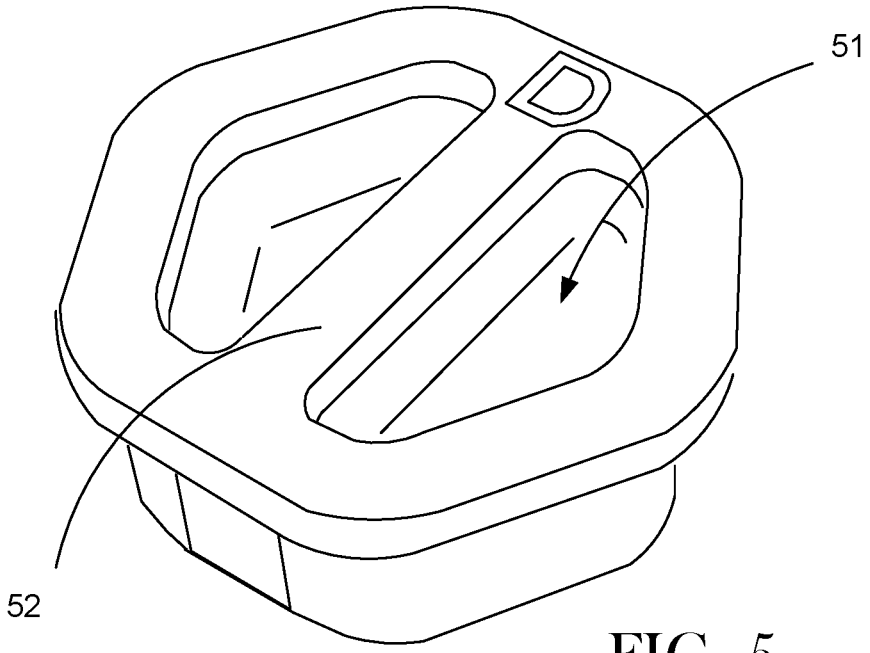
FIGS. 5-6 show preferred pegs.
Figure 6:
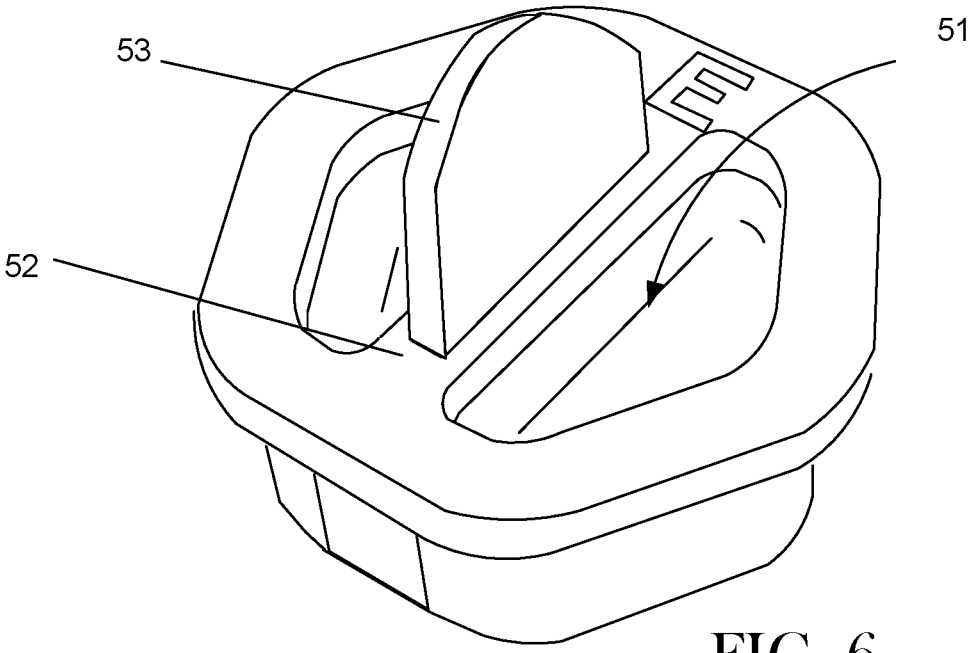

Hexagonal pegs 10 (FIG. 1) are shown in closer detail in FIGS. 5 and 6. For example, each peg is hexagonally shaped so as to be insertable and easily press-fit into cutout sections 50 on hexagon mount sections 1-3. Each peg 50 includes finger accessible cup section 51 that allows for finger access and grip section 52 that allows for the user to grab with his fingers. Also, optionally, peg 50 includes D-tab 53 that allows a user to more easily grab peg 50 or rest his fingers on peg 50 when using the peg.

Strap Attachment Pieces

Figure 7:
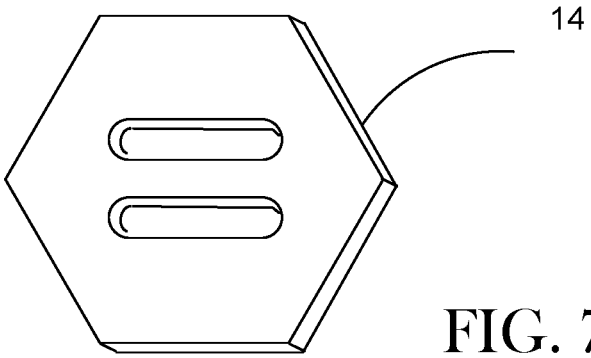
FIGS. 7-8 show preferred strap attachment devices.
Figure 8:
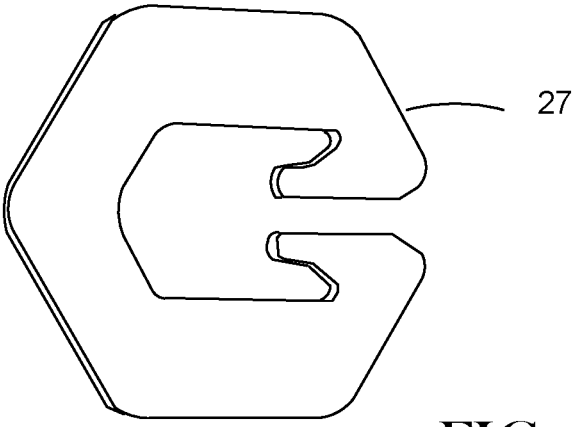

Strap attachment pieces 14 and 27 are shown in FIGS. 7 and 8. Strap attachment pieces are utilized to connect a strap (either flexible or non-flexible) to hexagon mount sections 1-3.

Utilization of the Present Invention

Figure 9:
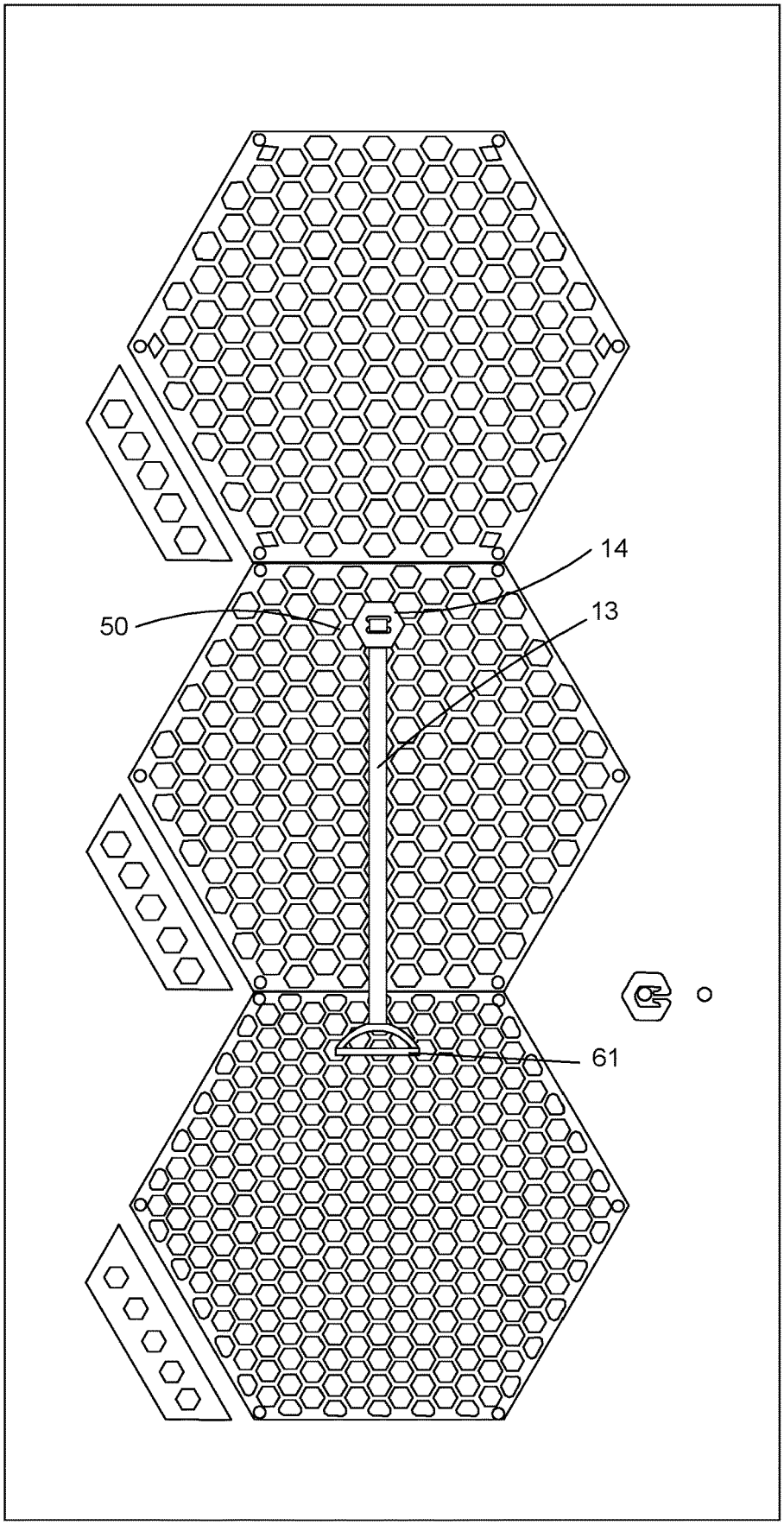
FIGS. 9-12 show preferred methods for using the physical therapy device.
Figure 10:
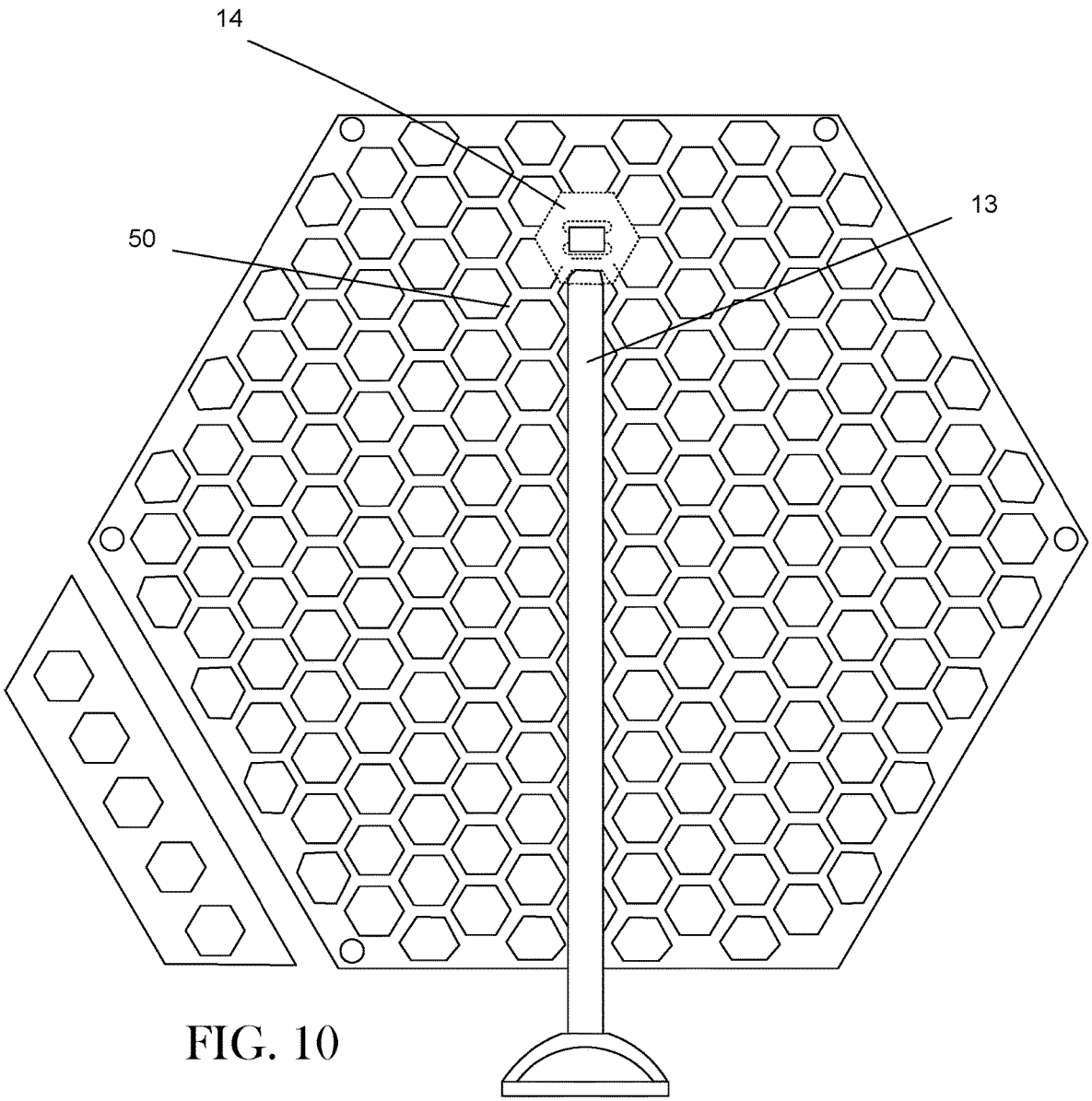

FIGS. 9-12 show examples of usage of physical therapy device 20. In FIG. 9, strap 13 has been treaded through cutout sections 50 of hexagon mount section 2 and threaded through strap attachment piece 14, as shown. A patient may now grab handle 61 and exercise and rehabilitate as needed. FIG. 10 shows a close-up view of strap 13 as it is threaded through cutout section 50 of hexagon 2 and strap attachment piece 14.

Figure 11:
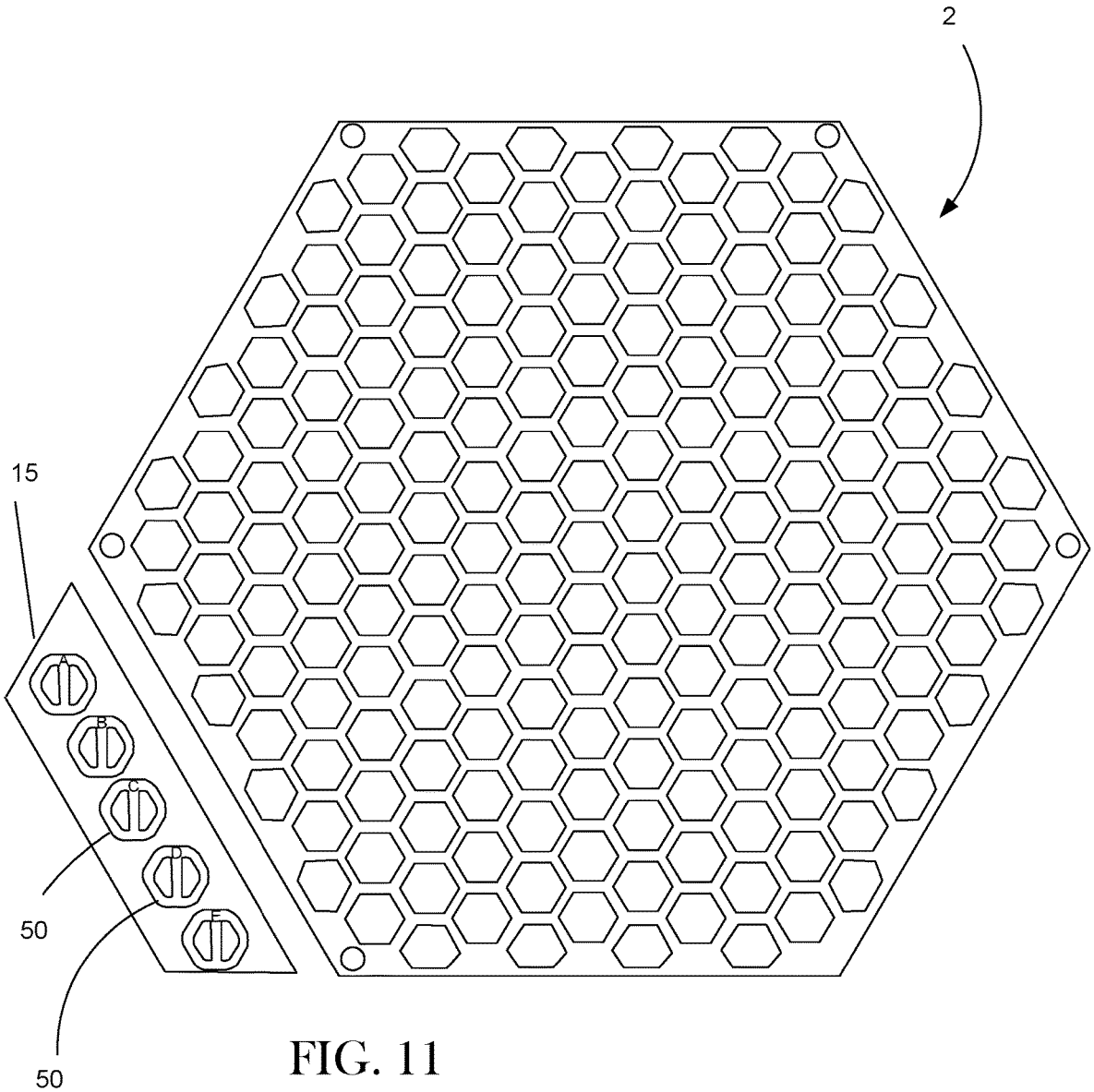

FIG. 11 shows a close-up view of hexagon mount section 2. Pegs 50 are being stored in peg holder 15. It should be noted that each peg 50 is marked as either peg A, peg B, peg C, peg D, or peg E. This will allow the patient to place the peg at an appropriate location on hexagon 2, in accordance with the physical therapy protocol.

Figure 12:
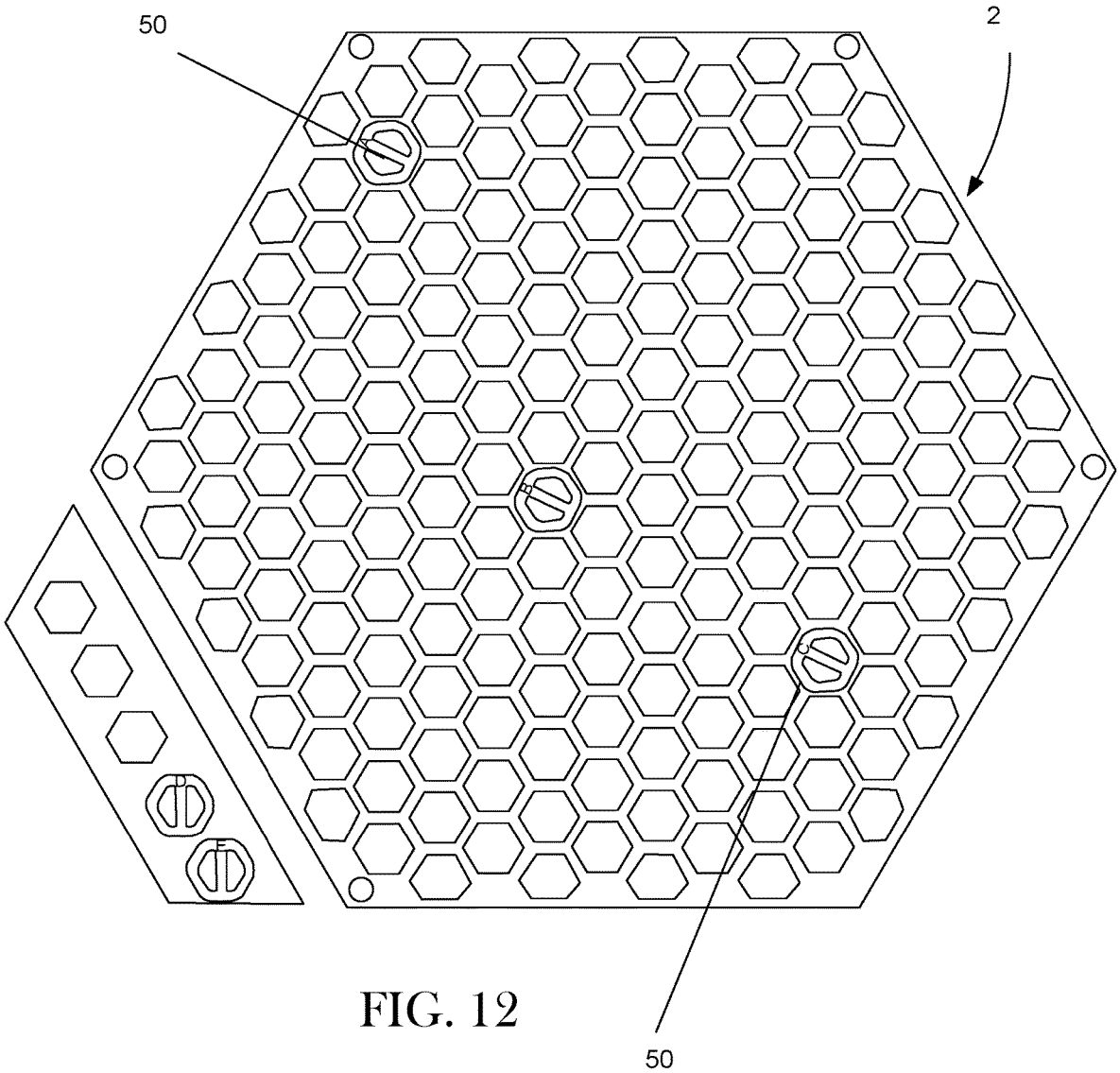

In FIG. 12, the patient has moved three of the pegs 50 (peg A, peg B and peg C) onto hexagon mount section 2. The patient may now engage in physical therapy.

Other Preferred Embodiment

Figure 13:
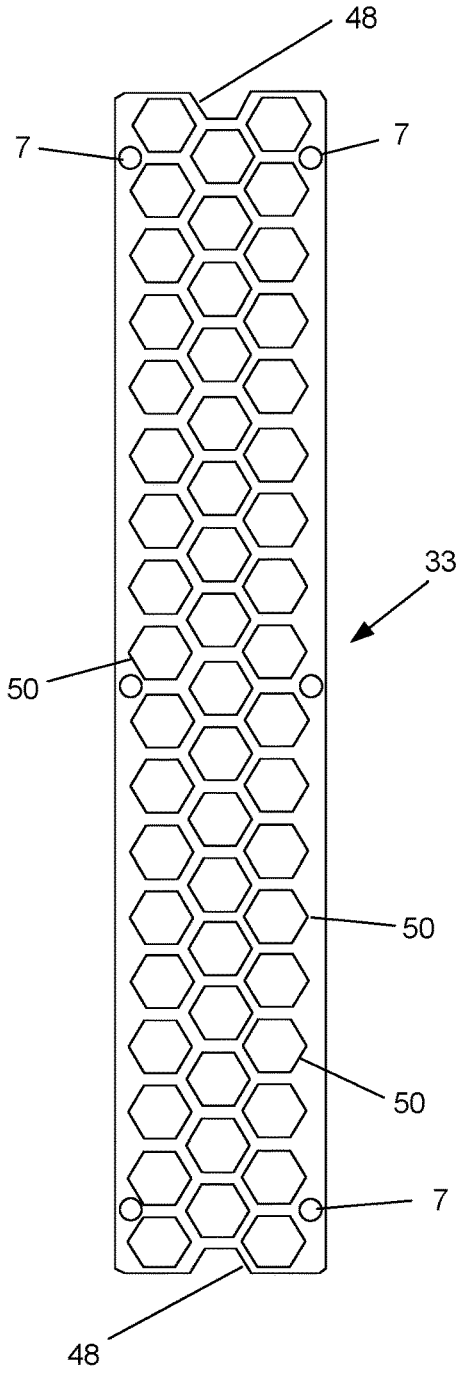
FIGS. 13-15 show another preferred embodiment of the present invention.
Figure 14:
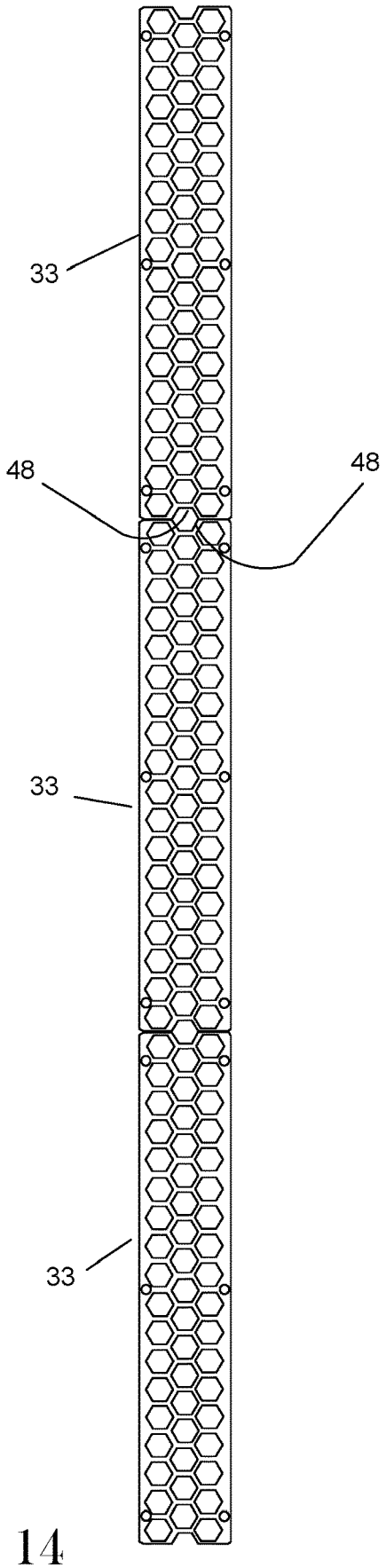
Figure 15:
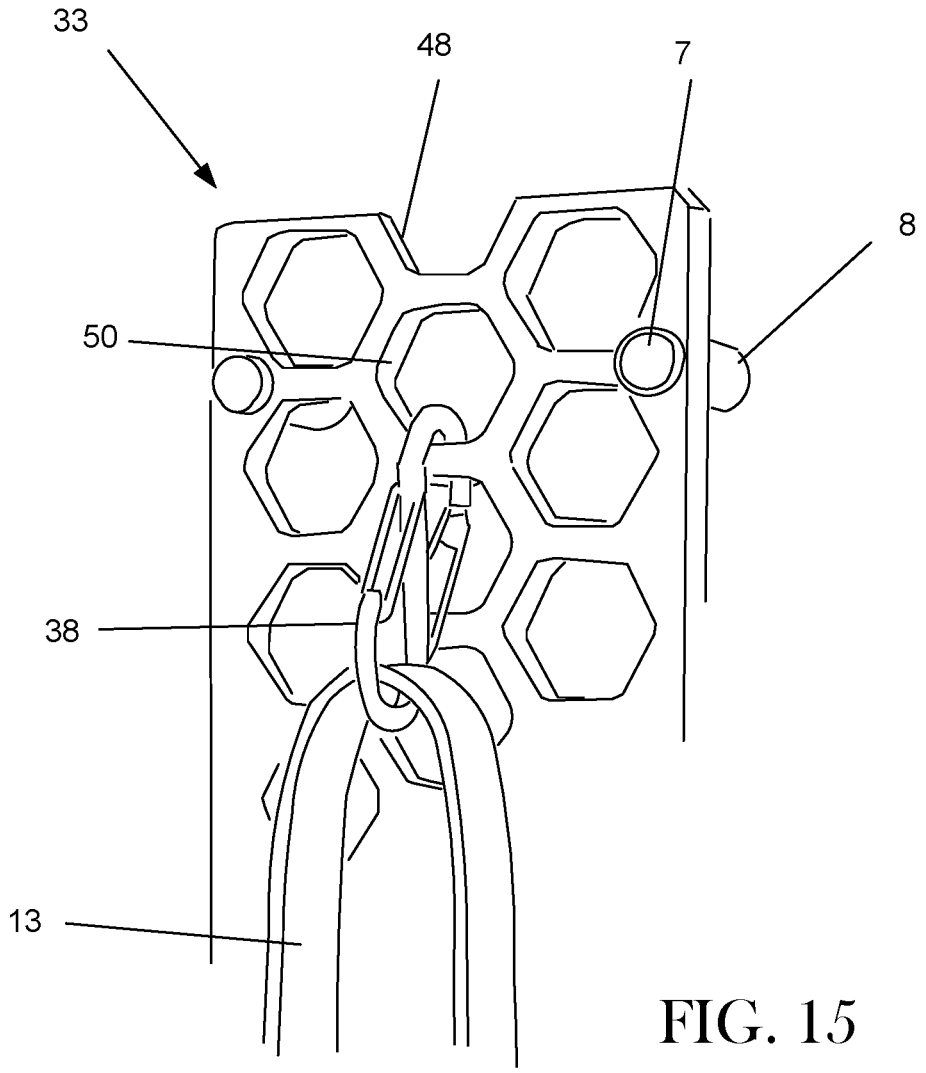

Another preferred embodiment of the present invention is shown in FIGS. 13-15. This preferred embodiment recognizes that the mount section does not have to be in the shape of a hexagon. For example, FIG. 13 shows rectangular mount section 33. In a preferred embodiment, rectangular mount section 33 is approximately 2 feet by 6 inches and includes multiple cutout sections 50 as shown. As with the earlier preferred embodiment, bolts 7 and spacers 8 are utilized for mounting (see also FIG. 15). Mount section 33 also includes edge cutout sections 48. Edge cutout sections 48 have the shape of half of a hexagon, so that when stacked, two edge sections 48 form a full cutout section 50 (FIG. 14).

FIG. 14 shows a preferred arrangement of mount sections 33. As shown, mount sections 33 are preferably stacked and mounted directly to the wall using bolts 7 and spacers 8 to separate each mount section 33 from the wall. Mount sections 33 are thin and tall when stacked in groups of three as shown in FIG. 14. This arrangement is ideal because it allows for physical therapy of patients of various heights. This arrangement is also valuable because it allows for installation where wall space may be limited, such as in a physical therapy office or for home use.

FIG. 15 shows detail of spring-loaded attachment clip 38 connected to mount section 33 via cutout section 50. Flexible strap 13 is looped through attachment clip 13. A patient may now grasp and pull on strap 13 as appropriate for physical therapy.

Another Preferred Embodiment

Figure 16:
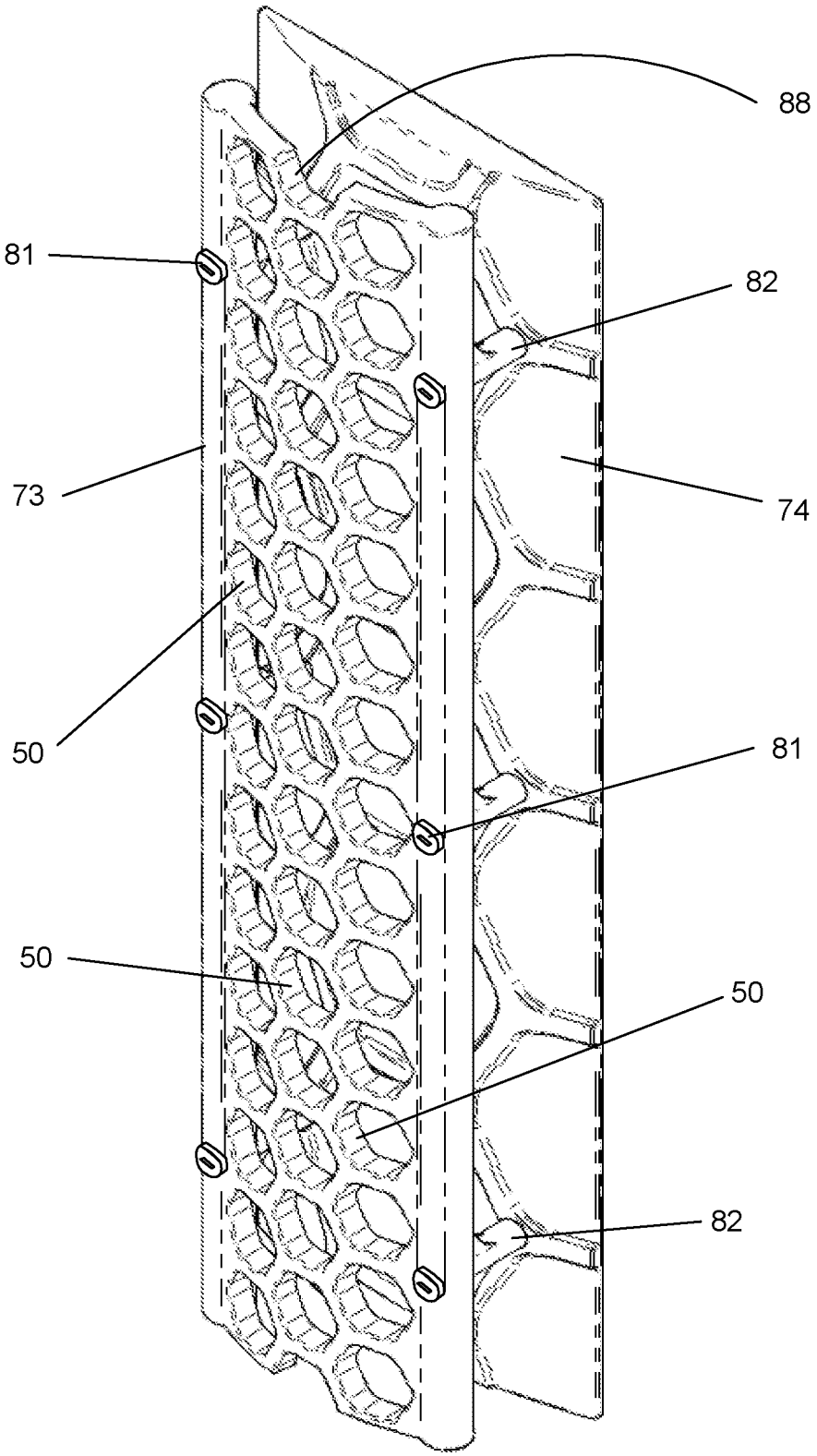
FIGS. 16-18 show another preferred embodiment of the present invention.
Figure 17:
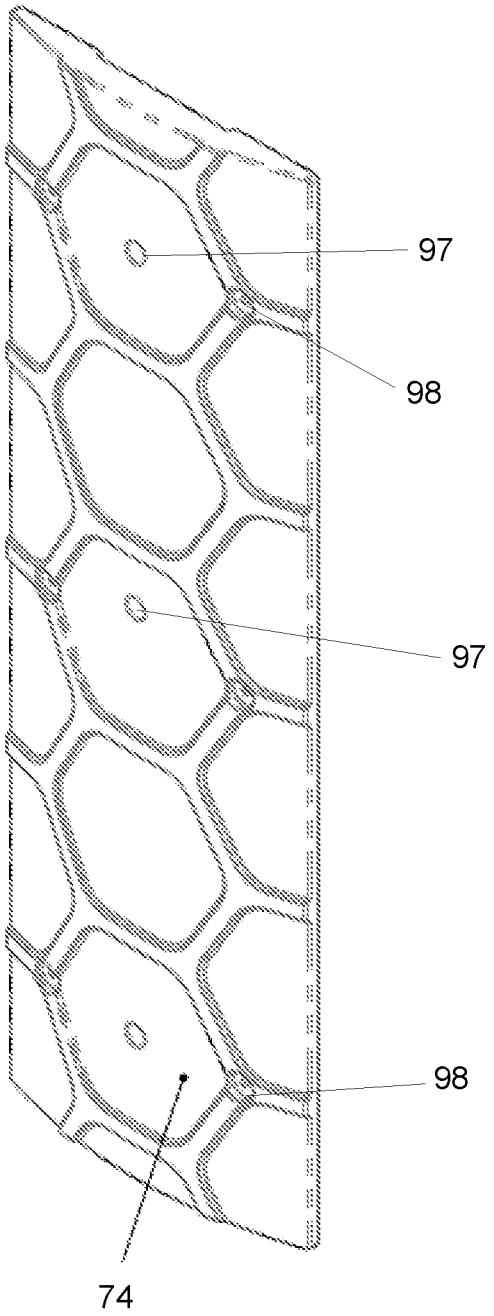
Figure 18:
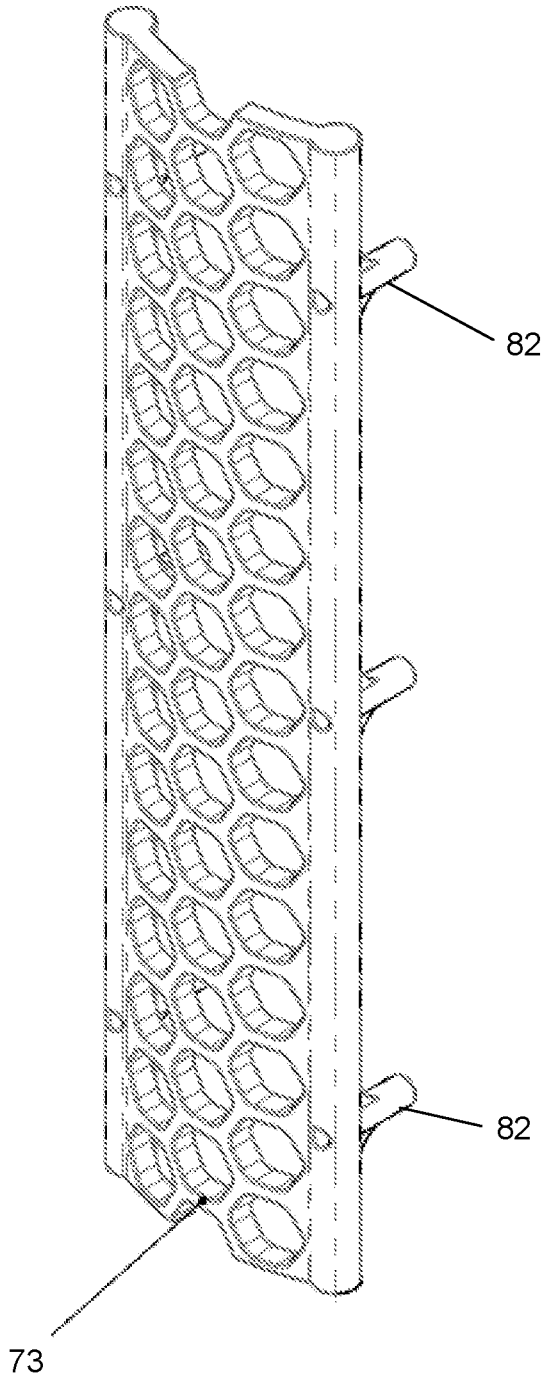

Another preferred embodiment is shown in FIGS. 16-18. This preferred embodiment utilizes convex mount section 73. For example, FIG. 16 shows rectangular, convex mount section 73 mounted to backing board 74. Because mount section 73 is convex, forces are distributed more efficiently as the user pulls on a flexible strap or band that is connected to mount section 73 via cutout section 50. In a preferred embodiment, rectangular, convex mount section 73 is approximately 2 feet by 6 inches and includes multiple cutout sections 50 as shown. Convex mount section 73 is mounted to backing board 74 by utilization of bolts 81 and spacers 82. Spacers 82 are preferably formed into convex board 73, as shown in FIGS. 16 and 18. Backing board 74 includes holes 98 for receiving bolts 81. Holes 97 allow for easy and convenient mounting to wall studs. Convex mount section 73 also includes edge cutout sections 88. Edge cutout sections 88 have the shape of half of a hexagon, so that when stacked, two edge sections 88 form a full cutout section 50.

Although the above-preferred embodiments have been described with specificity, persons skilled in this art will recognize that many changes to the specific embodiments disclosed above could be made without departing from the spirit of the invention. For example, Applicant has recognized that the hexagon is a very strong and efficient shape and is therefore preferred. A rectangular mount section has also been shown. However, it would also be possible to construct a similar physical therapy device using other geometric shapes, such as squares, triangles or heptagons. Therefore, the attached claims and their legal equivalents should determine the scope of the invention.

What is claimed is:

1. A physical therapy device, comprising:

A. at least one mount section mounted to a vertical surface, said at least one mount section comprising a plurality of cutout sections, and wherein said at least one mount section is a convex mount section, B. at least one attachment clip selectively connected to at least one of said plurality of cutout sections, and C. a plurality of spacers for spacing said at least one mount section away from said vertical surface.

2. The physical therapy device of claim 1, wherein said at least one mount section is a hexagon.

3. The physical therapy device of claim 1, wherein said at least one mount section is a rectangle.

4. The physical therapy device of claim 1, further comprising a backing board.

5. The physical therapy device of claim 4, wherein said backing board is vertically mounted to a wall.

6. The physical therapy device of claim 1 wherein said at least one mount section is three mount sections.

7. The physical therapy device of claim 1 wherein each mount section of the at least one mount section comprises at least one edge cutout section.

8. The physical therapy device of claim 7, wherein a respective edge cutout section of said each edge cutout section is configured to stack with a respective other of said each edge cutout section to form a full cutout section.

9. The physical therapy device of claim 1, wherein said plurality of spacers are formed into said at least one mount section.

10. The physical therapy device of claim 1, wherein said plurality of spacers are formed into said at least one mount section.

11. A physical therapy device, comprising:

A. at least one mount section mounted to a vertical surface, said at least one mount section comprising a plurality of cutout sections, B. at least one attachment clip selectively connected to at least one of said plurality of cutout sections, C. a plurality of spacers for spacing said at least one mount section away from said vertical surface, and D. at least one strap and a strap attachment piece, wherein said at least one strap is threaded through said at least one cutout section and said at least one strap attachment piece.

* * * * *